United States Patent [19]

Werft

[11] Patent Number: 4,489,943

[45] Date of Patent: Dec. 25, 1984

[54] PERSONAL PROTECTION DEVICE

[75] Inventor: August R. Werft, Venice, Fla.

[73] Assignee: Allan J. Werft, Chagrin Falls, Ohio ; a part interest

[21] Appl. No.: 457,758

[22] Filed: Jan. 13, 1983

[51] Int. Cl.[3] ..... F41B 15/06

[52] U.S. Cl. ..... 273/84 R; 43/5

[58] Field of Search ..... 273/84 R, 162 E; 43/5, 43/6; 135/66, 81

[56] References Cited

U.S. PATENT DOCUMENTS

| | | | |
|---|---|---|---|
| 802,264 | 10/1905 | Brown | 273/162 E X |
| 1,755,646 | 4/1930 | Halstead | 43/5 |
| 3,763,872 | 10/1973 | Gooley | 135/66 |

FOREIGN PATENT DOCUMENTS

| | | | |
|---|---|---|---|
| 559747 | 3/1944 | United Kingdom | 273/84 R |
| 1187979 | 4/1970 | United Kingdom | 273/84 R |

*Primary Examiner*—George J. Marlo

*Attorney, Agent, or Firm*—Hauke and Patalidis

[57] ABSTRACT

A hand-held device for personal protection. The device is provided with a hook at the end of a rod. When it is desired to strike at an attacker, the hook is thrust from within the housing of the device. The device can be provided with compression bias which requires a user to apply pressure to a knob to actuate the device or with a tension bias which permits the device to be actuated upon the release of a trigger-type arrangement.

11 Claims, 9 Drawing Figures

10
12
14
16
18
20
22
24
26
28
30
32
34
36
38
40
42
44
46
48
50
52
54
56
58
60
62
64
65
66
68
70
72
74
76
78
80
86
96

10
12
14
16
18
20
22
24
26
28
30
32
34
36
38
40
42
44
46
48
50
52
54
56
58
60
62
64
65
68
70
72
74
76
78
80
86
96

10
12
14
16
18
20
22
24
26
28
30
32
34
36
38
40
42
44
46
48
50
52
54
56
58
60
62
64
65
66
78
86
96

PERSONAL PROTECTION DEVICE

BACKGROUND OF THE INVENTION

The present invention relates to hand-held devices for personal protection. More particularly, the invention relates to a lightweight protection device wherein an assailant is repelled from his attack upon being stricken by the device.

Rapes, muggings, purse snatchings and other physical assaults are a serious problem in the world today. These attacks often result in bodily harm, mental anguish and loss of property.

Each known method of personal protection has certain disadvantages. Firearms and knives, for example, cannot be carried upon the person of most citizens without violation of Federal and State statutes. Even those citizens who are permitted to carry such dangerous weapons may not wish to inflict as massive an injury to another as is typical with such weapons. In addition, such weapons have been shown to carry a substantial risk of injury to the owner through accidental discharge or impalement.

Commercially sold gas cannisters, contemplated for spraying into the face of an attacker, for example, have also been shown to be ineffective for their intended purpose. In reality, such cannisters are difficult to aim accurately, particularly where the victim is taken by surprise. The deterrent effect of the spray in such cannisters, even if actually administered to an assailant in a strong dose has also been questioned. Moreover, these sprays are especially susceptible to weakening if sprayed any substantial distance through the ambient.

Knowledge of assaultive techniques, such as karate and judo is also an unacceptable alternative for many persons. Some people simply lack the physical size necessary to employ such techniques effectively or lack the self-discipline required to master such techniques in the first instance.

What is needed therefore is a new personal protection device which is easy to operate, effective in its intended purpose of deterring attack and which is inexpensive to manu- facture.

SUMMARY OF THE INVENTION

The present invention accomplishes its objects by providing a lightweight, hand-held personal protection device which deters an attacker by means of a hook member, being a three-pronged fish hook, for example, mounted on the end of a rod, preferably in a break-away fashion, and which hook-provided rod is thrust from within the protection device housing by easy to operate displacing means.

The invention contemplates a wide variety of embodiments wherein the displacing means operates against a compression bias or in co-operation with a tension bias, for example, through squeezing of a push member or releasing of a "trigger". Additionally, the invention may be applied in several suitable housings ranging from a relatively small gun-configured housing to a relatively large walking-cane configured housing.

DETAILED DESCRIPTION OF THE PREFERRED EMBODIMENT

Figure 1:
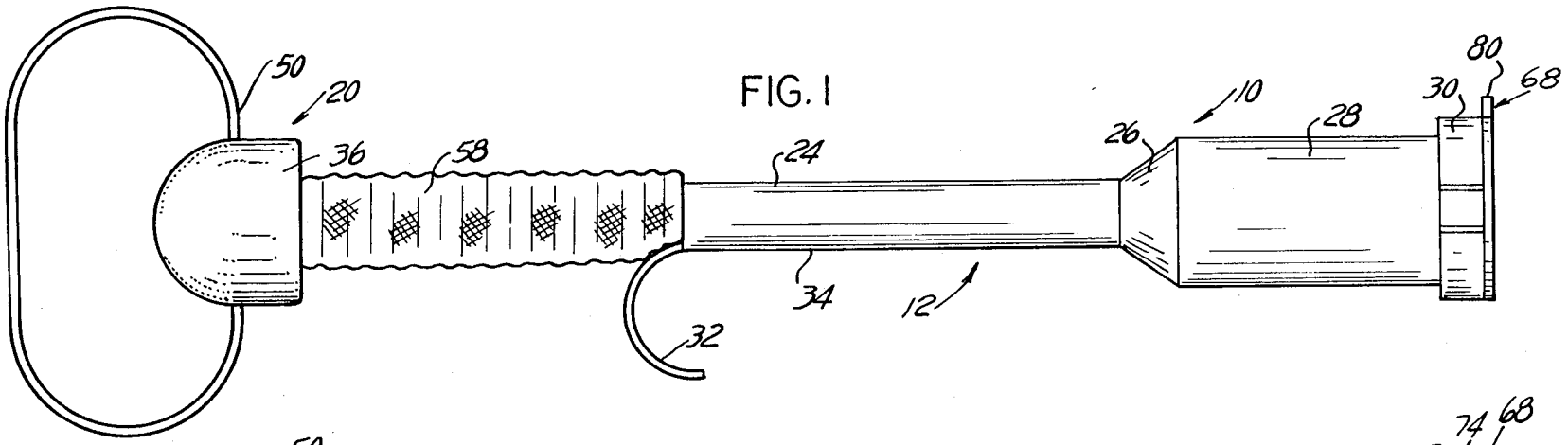
FIG. 1 is a side elevation view of an example of a personal protection device according to the invention.
Figure 2:
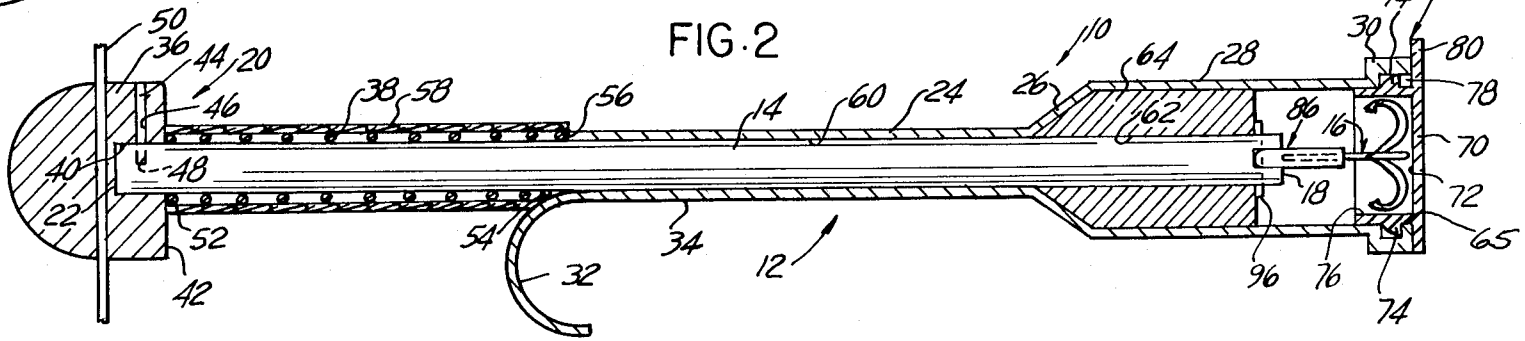
FIG. 2 is a cross-sectional view thereof along line 2—2 of FIG. 1.
Figure 3:
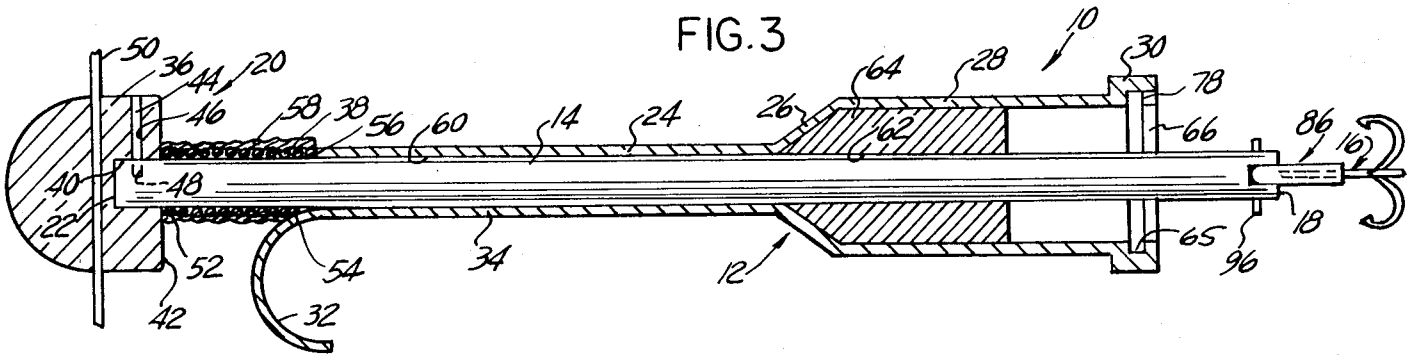
FIG. 3 is a view similar to FIG. 2, but with a part omitted and showing the position of elements following actuation of the device.

Referring now to the drawing, and more particularly to FIGS. 1–3 thereof, an example of a personal protection device 10 is shown comprising a housing 12, a reciprocable rod 14 slidably disposed in the housing 12, a hook member 16 projecting from an end 18 of the rod 14 and displacing means 20 coupled to the other end 22 of the rod. The displacing means 20, as explained hereafter, displaces the rod 14 from the inoperative position wherein the hook member 16 projecting from the end 18 of the rod 14 is disposed within the housing 12, as shown at FIG. 2, to an operative position wherein the hook member 16 projects outside the housing 12 as shown at FIG. 3.

In the example of personal protection device 10 illustrated at FIGS. 1–3, the housing 12 is elongated and is provided with a tubular body portion 24 integrally connected by a stepped or conical portion 26 to a first enlarged diameter portion 28 and second enlarged diameter portion 30. An integrally formed arcuate member 32, which aids a person in applying pressure to the displacement means 20, as also explained hereafter, extends downwardly from the exterior surface 34 of the tubular portion 24 of the housing 12.

In the embodiment of FIGS. 1–3 the displacing means 20 comprises a push member 36, in the form of a knob, which enables a person pressing the push member 36 towards the housing 12 to displace the rod 14 to an operative position against biasing means 38 acting to urge the rod 14 toward an inoperative position. The push member 36 is substantially hemispherical and is coupled to the rod 14, for example, by inserting the end 22 of the rod 14 into a radial bore 40 of the push member 36, which radial bore 40 extends through an end face 42 of the push member 36. After insertion of the end 22 of the rod 14 into the radial bore 40 of the push member 36, a pin 44 is inserted through aligned transverse bores in the push member 36 and the rod 14. The push member 36 is also a suitable location for passing therethrough a carrying cord or strap 50, FIGS. 1–3.

The biasing means 38, shown as a compression coil spring, is disposed around the rod 14 with its ends 52 and 54 abutting respectively an end surface 56 of the housing 12 and the end face 42 of the push member 14. To protect the compression spring from becoming entangled in the material of a cloth pocket, for example, the spring is preferably enclosed in a sleeve 58 made of any suitable flexible material such as canvas or flexible plastic.

It is readily apparent that the purpose of the aforementioned arcuate member 32 extending downwardly from the exterior surface 34 of the tubular portion 24 of the housing 12 is to provide a leverage point to a person desiring to operate the device by pressing the push member 36 and displacing the rod 14. After placing the push member 36 in the palm of a hand, the arcuate member 32 is conveniently disposed for bending a finger around and squeezing the palm toward the finger.

The reciprocable rod 14 is slidably disposed in the housing 12 by being passed through aligned, axial, longitudinal bores 60, 62 in the tubular body portion 24 of the housing 12 and an internal collar 64 mounted in the housing 12. More particularly, the internal collar 64 is configured to be affixed about its periphery by appropriate means to the interior surfaces of the first enlarged diameter portion 28 and stepped portion 26 of the housing 12 with a tight fit. The collar 64 permits the rod 14 to be supported within the housing 12 along a greater portion of its length than if the collar 64 is omitted.

With the rod 14 disposed through the aligned axial bores 60, 62 of the tubular portion 24 of the housing 12 and the internal collar 64 of the housing 12, the end 18 of the rod 14 to which the hook member 16 is connected projects forwardly from the axial bore 62 of the collar 64. When the device 10 is in an inoperative condition, FIG. 2, the projecting end 18 of the rod 14, from which the hook member protrudes is disposed within the first enlarged diameter portion 28 of the housing 12, and the hook member 16 is safely disposed within the second enlarged diameter portion 30 which acts as a shield. When the device 10 is in an operative condition as a result of actuation of the displacing means 20, FIG. 3, the forwardly projecting end 18 of the rod 14 is displaced from the first enlarged diameter portion of the housing 12 through an opening 65 in the end wall 66 of the housing 12 to outside the housing 12 with the hook member 16 appropriately positioned at the end 18 of the rod 14 for striking at an attacker.

To prevent the hook-provided, forwardly projecting, end 18 of the rod 14 from being accidentally displaced to its operative position by actuation of the displacing means 20, a removable safety cap 68 is preferably inserted through the opening 65 of the end wall 66 of the housing 12 and into the second enlarged diameter portion 30 of the housing 12 such as to close the opening 65 in the end wall 66. The safety cap 68 illustrated at FIGS. 1 and 2 comprises a relatively narrow, circularly cylindrical solid body portion 70 substantially identical in circumference to the end wall 66. The body portion 70 of the safety cap 68 is provided on one lateral surface 72 with a pair of perpendicularly projecting, diametrically opposed, arcuate rims 74, FIG. 2, each of the rims 74 being disposed concentric and in close proximity to a tubular portion 76 protruding at right angles from the center of the lateral surface 72. The exterior circumference of the tubular portion 76 is close in size to the interior circumference of the first enlarged diameter portion 28 of the housing 12. When the safety cap 68 is inserted into the housing 12 through the opening 65, each arcuate rim 74 engages a portion of the end wall 66 and the tubular portion 76 extends through the second enlarged diameter portion 30 into the first enlarged diameter portion 28 where it is frictionally held by a tight fit. A slot 78 is provided proximate the top of the end wall 66 to permit introduction of the top rim 74 of the safety cap 68. An upwardly protruding lip 80 is provided at the top of the exterior of the safety cap 68 for pulling the end cap 68 from the housing 12.

As an additional feature of the invention, the hook member 16 is preferably attached to the forwardly projecting end 18 of the rod 14 in a "break-away" fashion thereby allowing a user of the device 10 to implant the hook member 16 into an assailant and separate the hook member 16 from the rod 14 upon a predetermined amount of slight pull, between approximately 5 and 10 lbs., being applied to the rod 14. This feature avoids the undesirable situation where a potential victim having the carrying strap 50 around the wrist impales his or her attacker with the hook member 16 only to become attached to the attacker through the device 10.

Figure 4:
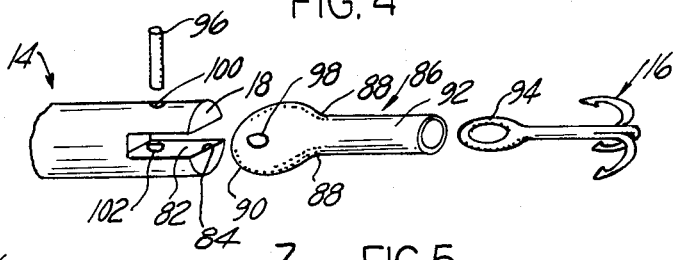
FIG. 4 is an exploded view of a portion of the device of FIG. 1.

One type of break-away arrangement for attaching a hook member 16 to the forwardly projecting end 18 of the rod 14 is best shown at FIG. 4. A transverse longitudinal slot 82 is provided along the forwardly projecting end 18 of the rod 14. The transverse longitudinal slot 82 forms an opening 84 at the end 18 of the rod 14 for inserting a casing or sheath 86 therein. The sheath 86, being made of plastic or elastomeric material, for example, has flexible, deformable sidewalls 88, is substantially eliptical at the one end 90, and is provided at the other end with a tubular opening 92 so that an eye portion 94 of the hook member 16 can be inserted into the sheath 86. The eliptical end 90 of the sheath 86 snuggly retains the eye portion 94 of the hook member 16 until a predetermined amount of pull is applied to the hook member 16 through the rod 14. Upon such pull the sidewalls 88 of the sheath 86 deform so as to release the eye portion 94 of the hook member 16 through the tubular opening 92 of the sheath 86. The sheath 86 itself is retained in the transverse longitudinal slot 82 of the rod 14 by a pin member 96 passed through a transverse bore 98 in the eliptical end 90 of the sheath 86 and through aligned transverse bores 100, 102 in the forwardly projecting end 18 of the rod 14, which aligned transverse bores 100, 102 in the forwardly projecting end 18 of the rod 14 communicate with the transverse longitudinal slot 82 in which the sheath 86 is inserted. The pin 96 serves the additional function of limiting the retraction of the rod 14 by the biasing means 38 by preventing the forwardly projecting end 18 of the rod 18 from entering the axial longitudinal bore 62 of the collar 64.

In contrast to the embodiment of the invention illustrated at FIGS. 1–3 wherein the displacing means 20 operate against compression biasing means 38, which biasing means 38 acts to urge the rod 14 to an inoperative position, the embodiment of the invention shown at FIGS. 5–9 is an example of structure wherein the displacing means operate to release tension biasing means, which tension biasing means acts to urge the rod to an operative position. For the purpose of illustration the device 10 of FIGS. 1–3, incorporating the compression bias, is generally "gun" configured and the device 10' of FIGS. 5–9, incorporating a tension bias, is generally "cane" configured. It will be appreciated, however, that any number of housing shapes could be suitable to incorporate the invention with tension or compression biasing means.

The personal protection device 10' shown at FIGS. 5–9 comprises an elongated, circularly cylindrical housing 12' and a spherical handle member 104 affixed across a portion of its periphery to an arcuate end 106 of the housing 12' by any suitable means, such as threaded engagement, not shown. Biasing means, consisting of a compression coil spring 108, are disposed in a radial bore of the handle member 104 as more fully described hereafter.

Figure 5:
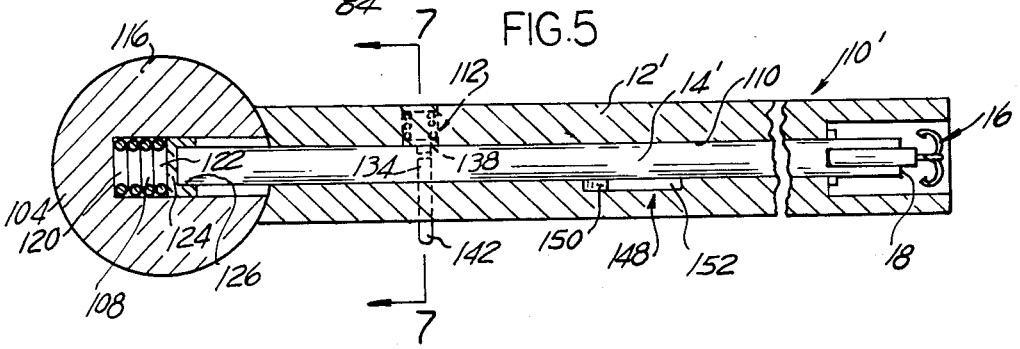
FIG. 5 is a view similar to FIG. 2 but showing a modification of a personal protection device according to the invention.
Figure 6:
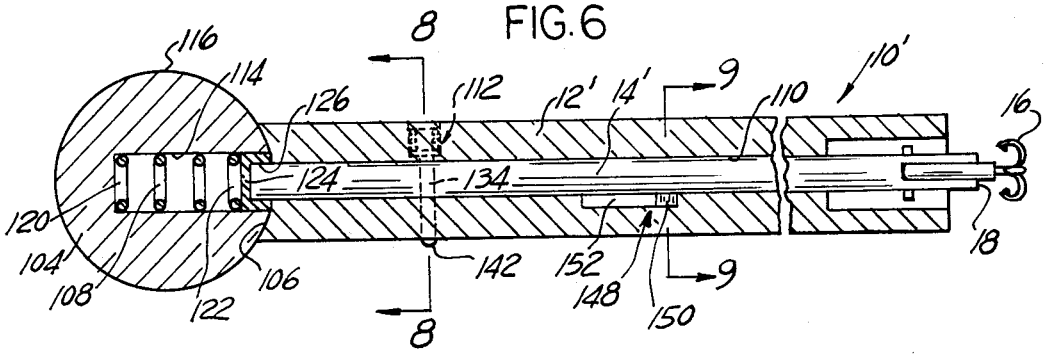
FIG. 6 is a view similar to FIG. 5 but showing the position of elements following actuation of the device.
Figure 7:
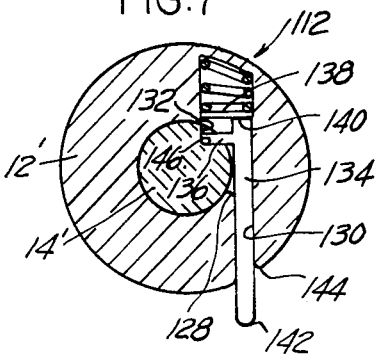
FIG. 7 is a cross-sectional view along line 7—7 of FIG. 5.
Figure 8:
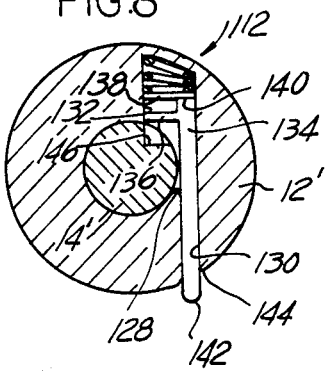
FIG. 8 is a cross-sectional view along line 8—8 of FIG. 6.

The biasing means act to urge a reciprocable rod 14' slidably disposed in an axial longitudinal bore 110 of the housing 12' from an inoperative position, shown at FIG. 5, to an operative position, as shown at FIG. 6. Holding means 112, designed to act in a "trigger" fashion, are transversely mounted in the housing 12' proximate the arcuate end 106 of the housing 12'. The holding means 112, as also more fully explained hereafter, are manually displaceable from a first position wherein the rod 14' is prevented from being urged to an operative position by the compression spring 108 mounted in the handle member 104, FIGS. 5 and 7, to a second position wherein the rod 14' is free to be urged to the operative position by the compression spring 108, FIGS. 6 and 8.

The compression spring 108 is disposed within a radial bore 114 formed in the handle member 104. The radial bore 114 extends through the exterior surface 116 of the handle member 104 such as to form an opening, not seen, and the radial bore 114 of the handle member 104 is in coaxial alignxent with the axial longitudinal bore 110 of the housing 12'. It will be appreciated, however, that the axial longitudinal bore 110 of the housing 12' is of a relatively smaller circumference than the radial bore 114 of the handle member 104. The reciprocable rod 14' slidably disposed in the axial longitudinal bore 110 of the housing 12' extends into the radial bore 114 of the handle member 104 through the opening. More particularly, the spring 108 is disposed such that one end 120 abuts the closed end of the radial bore 114 in the handle member 104 and the other end 122 of the spring 108 abuts an end cap 124 affixed to the end portion of the rod 14'. The end cap 124 is circularly cylindrical, for example, and has an exterior circumference which is close in size to the interior circumference of the radial bore 114 of the handle member 104 such as to be slidably engaged therein. The rod 14' is affixed to the slidable end cap 124 by being inserted in a longitudinal bore 126 formed through one surface of the end cap 124. The rod 14' is thereafter secured in a longitudinal bore 126 of the end cap 124 by any suitable means, such as a pin, for example, not shown. Upon release of the holding means 112, FIG. 6, the end cap 124 is slidably displaced in the radial bore 114 by the compression spring 108 until it comes into abutment with the arcuate end 106 of the housing 12'. The end cap 124 may not continue into the axial longitudinal bore 110 of the housing 12', however, due to the relatively smaller size of the housing bore 110 and therefore the end of the rod 14' to which the end cap 124 is attached is also prevented from escaping the radial bore 114 of the handle member 104.

At FIGS. 5–8 an example of holding means 112 is illustrated comprising a transverse bore 128 in the housing 12' having relatively small and relatively large diameter portions 130, 132, an elongated release member 134 slidably disposed in the relatively small diameter portion 130 of the transverse bore 128, an engagement member 136 protruding at right angle from an exterior surface of the release member 134 and a spring-loaded plunger 138 disposed in the relatively large diameter portion 132 of the transverse bore 128 such that the plunger 138 engages one end 140 of the release member 134. The other end 142 of the release member 134 protrudes through an opening 144 in the housing 12 formed by the transverse bore 128. The spring-loaded plunger 138 urges the engagement member 136 protruding from the release member 134 into engagement with a notch 146 in the rod 14' when the holding means 112 is in a first position, FIGS. 5 and 7, thereby preventing the rod 14' from being urged to its operative position by the compression spring biasing means 38. When it is desired to have the rod 14' displaced to an operative position by the biasing means 38 the holding means 112 is displaced to a second position by pressing the end 142 of the release member 134 protruding through the opening 144 toward the housing 12' of the device 10' thereby urging the end 140 of the release member 134 against the spring loaded plunger 138 and disengaging the engagement member 136 from the notch 146 in the rod 14', FIGS. 6 and 8.

Figure 9:
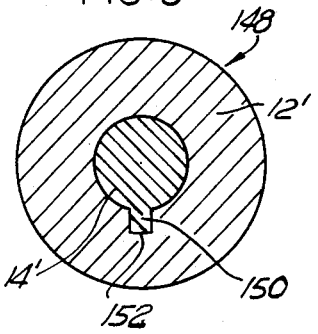
FIG. 9 is a cross-sectional view along line 9—9 of FIG. 6.

As illustrated at FIGS. 6 and 9, any device according to the invention may also be provided with means preventing rotation 148 of the rod 14' in the housing 12' when the rod 14' is displaced to an operative position by the displacing means. The means for preventing rotation 148 of the rod 14' may consist, for example, of an integral lip 150 protruding at substantially right angle from the exterior surface of a portion of the rod 14', which integral lip 150 is slidably disposed in a longitudinal groove 152 in the housing 12' . More particularly, the groove 152, as shown is in communication with and extends along a portion of the longitudinal, axial bore 110 of the housing 12' in which the rod 14' is slidably disposed. When the device is in an inoperative position, FIG. 5, the lip 150 is disposed proximate the rearward end of the groove 152. Upon actuation of the displacing means the lip 150 slides forward in the groove 2 as the rod 14' is displaced to an operative position with the lip 150 holding the rod 14' against rotation. It is apparent that the groove 152, therefore, must be at least equal in length to the distance it is desired to displace the rod 14'.

The various elements of the personal protection devices described herein can be manufactured of any suitable material, such as plastic, metal or wood. The illustrated housings may be integrally molded of one piece, if desired, except where the above-described means for preventing rotation of the rod are employed, wherein it is necessary to form the housing of at least two sections as the lip 150 will prevent the rod 14' from being inserted into the longitudinal axial bore 110 of a onepiece housing 12'.

At least the housing of the device of the invention is preferably coated with a high visibility, preferably light reflective paint, such as orange light reflective paint. Although the hook member 16 is preferably a fishing hook any other type of barbed hook may be used. Also it is contemplated that the hook member may bear some identification, indicating its origin, or be coated with a poorly adhering trace material remaining attached to an assailant's skin even though he may be able to remove the hook without medical intervention.

The device of the invention may also be used as a fishing implement by providing permanent attachment of the hook member 16 to the end of the rod 14 or 14' by the pin 96 passed through the hook member eye 94. Such a fishing implement is particularly attractive to snorkelers or scuba divers who are thus enabled to catch a fish by directly hooking the fish at any portion of its body.

Having thus described the present invention by way of examples of structure thereof well adapted to accomplish the objects of the invention, modifications whereof will be apparent to those skilled in the art, what is claimed as new is as follows:

1. A hand-held non-lethal personal defense and fishing device comprising an elongated housing, an axial longitudinal bore extending through at least a portion of said housing, a slidably reciprocable rod axially disposed in said axial longitudinal bore of said housing, a single hook member projecting from one end of said rod, said hook member being in the form of a fishing hook having at least three substantially evenly disposed barbs, means for directly attaching said hook member to said one end of said rod, and rod displacing means provided proximate the other end of said rod, wherein actuation of said rod displacing means longitudinally displaces said rod from an inoperative position whereby said hook member is disposed within said housing to an inoperative position whereby said hook member projects from said housing.

2. The device of claim 1 further comprising biasing means urging said rod toward said inoperative position.

3. The device of claim 1 wherein said rod displacing means comprises a push member coupled to said other end of said rod.

4. The device of claim 2 wherein said rod displacing means comprises a push member coupled to said other end of said rod.

5. The device of claim 4 wherein said biasing means urging said rod toward said inoperative position comprises a compression spring disposed around said rod, said spring having one end abutting an end surface of said push member and another end abutting an end surface of said housing.

6. The device of claim 1 wherein said rod displacing means comprises biasing means urging said rod toward said operative position and holding means manually displaceable from a first position wherein said holding means prevents said rod from being urged toward said operative position by said biasing means to a second position wherein said rod is free to be urged toward said operative position by said biasing means.

7. The device of claim 6 wherein said biasing means urging said rod towards said operative position comprises a handle member affixed to an end surface of said housing, a radial bore in said handle member extending through the exterior surface of said handle member such as to form an opening, said radial bore in said handle member being aligned with said axial longitudinal bore in said housing, said radial bore in said handle member slidably accepting an end portion of said rod passed through said opening, a compression spring disposed in said radial bore of said handle member with the ends of said compression spring disposed between a closed end of said radial bore of said handle member and an end cap affixed to said end portion of said rod.

8. The device of claim 6 wherein said holding means comprises a transverse bore in said housing, said transverse bore forming an opening through one side of said housing, said transverse bore having a relatively small diameter portion proximate said opening and a large diameter portion, an elongated release member slidably disposed in said small diameter portion of said transverse bore, one end of said release member protruding through said opening and the other end of said release member abutting a spring-loaded plunger disposed in said relatively large diameter portion of said transverse bore, and an engagement member protruding substantially at right angle from the exterior surface of said release member wherein said spring-loaded plunger urges said engagement member protruding from said release member into engagement with a notch in said rod when said holding means is in said first position and wherein said holding means is displaced to said second position by applying pressure to said one end of said release member protruding through said opening of said housing which thereby displaces said other end of said release member against said spring-loaded plunger and disengages said engagement member protruding from said release member from said notch in said rod.

9. The device of claim 8 wherein said means for attaching said hook member to said one end of said rod comprises a transverse longitudinal slot provided through a portion of said rod, said transverse longitudinal slot forming an opening at said one end of said rod for inserting a sheath into said slot, an end of said sheath being affixed to an end portion of said hook member, a transverse bore being provided through said sheath proximate the other end of said sheath, aligned transverse bores in said rod, said aligned transverse bores in said rod communicating with said slot in said rod, and a pin member passed through said aligned transverse bores in said rod and through said transverse bore in said sheath inserted in said slot.

10. The device of claim 1 wherein said hook member separates from said one end of said rod upon a predetermined amount of pull being applied to said rod.

11. The device of claim 1 further comprising an integral lip protruding at substantially right angle from the exterior surface of a portion of said rod, a longitudinal groove in said housing, said longitudinal groove in said housing being in communication with and extending along a portion of said axial longitudinal bore of said housing, said lip being slidably engaged within said longitudinal groove in said housing to hold said rod against rotation in said axial longitudinal bore.

* * * * *